US007431412B2

(12) United States Patent
Flotats et al.

(10) Patent No.: US 7,431,412 B2
(45) Date of Patent: Oct. 7, 2008

(54) MEDIA-POSITION SENSOR SYSTEM

(75) Inventors: Carles Flotats, Barcelona (ES); David Claramunt, Sant Esteve Sesrovires (ES); Jose M Rio Doval, Sant Cugart del Valles (ES); Rodrigo Ruiz, Terrassa (ES); Francesc Subirada, Castellbisbal (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 311 days.

(21) Appl. No.: 10/977,368

(22) Filed: Oct. 29, 2004

(65) Prior Publication Data

US 2005/0280665 A1 Dec. 22, 2005

(30) Foreign Application Priority Data

Oct. 31, 2003 (EP) ..... 03104047

(51) Int. Cl.
*B41J 25/308* (2006.01)

(52) U.S. Cl. ..... 347/8; 347/9; 347/19

(58) Field of Classification Search ..... 347/8, 347/19, 14, 9, 12; 400/56, 59
See application file for complete search history.

(56) References Cited

U.S. PATENT DOCUMENTS

| | | | | |
|---|---|---|---|---|
| 6,118,132 | A | 9/2000 | Tullis | 250/559.39 |
| 6,471,315 | B1 * | 10/2002 | Kurata | 347/8 |
| 6,629,787 | B2 * | 10/2003 | Lee et al. | 400/59 |

FOREIGN PATENT DOCUMENTS

| | | | |
|---|---|---|---|
| EP | 0 622 239 | A2 | 4/1994 |
| EP | 1 195 258 | A | 4/2002 |
| WO | 96/35112 | | 11/1996 |
| WO | 02/46713 | A2 | 6/2002 |

* cited by examiner

*Primary Examiner*—Lam S Nguyen

(57) ABSTRACT

A printer device comprising a mechanism adapted to generate an image on an image surface, the device comprising a sensor adapted to image a predetermined optical object located substantially on the image surface, the device being adapted to determine at least one dimension of the object's image and thereby determine the distance separating the mechanism and the image surface.

20 Claims, 6 Drawing Sheets

MEDIA-POSITION SENSOR SYSTEM

FIELD OF THE INVENTION

The present invention relates generally to hardcopy devices, particularly but not exclusively to inkjet printers and to methods of operating such printers.

BACKGROUND TO THE INVENTION

As is well known in the art, conventional inkjet printers generally employ one or more inkjet cartridges, often called "pens", which eject drops of ink onto a page or sheet of print media. The pens are usually mounted on a carriage, which is arranged to scan relative to a sheet of print media as the pens print a series of individual drops of ink on the print media. Often, the pens scan across a scan axis relative to a stationary sheet of print media. The series of drops collectively form a band or "swath" of an image, such as a picture, chart or text. Between scans, the print medium is advanced relative to the scan axis. In this manner, an image may be incrementally printed. In other arrangements, the pens, in the form of a page wide array for example, may remain stationary with the print media being past the print bar.

The distance which an ink drop travels from a print head to the ink receiving surface of the print medium is often known as the pen-to-paper spacing. For high-quality image formation the pen-to-paper spacing is desirably precisely controlled. If the spacing to too little, the risk that a print head may impact against the print media increases. This is especially likely where the print media expands on absorbing water contained in the ink printed on its surface. This expansion may cause undulations or wrinkles in the plane of the print media. As a consequence, the distance between the print media and the print head decreases at some localized points. If, on the other hand, the pen-to-paper spacing is too great, the ejected dots may not be accurately positioned on the surface of the print medium. Other artefacts which also degrade print quality may also occur.

The pen-to-paper spacing in an inkjet printer is set during assembly of the printer. This process is generally repeated only when the carriage is replaced in a major servicing operation.

SUMMARY OF THE INVENTION

According to one aspect of the invention, there is provided a printer device comprising a mechanism adapted to generate an image on an image surface, the device comprising a sensor adapted to image a predetermined optical object located substantially on the image surface, the device being adapted to determine at least one dimension of the object's image and thereby determine the distance separating the mechanism and the image surface.

In certain embodiments of the present invention, the distance separating the image forming mechanism and a surface upon which an image may be formed may be readily determined, without the need for a time-consuming servicing operation. In certain embodiments of the present invention, the process determining the separation distance, or pen-to-paper spacing, may be performed in a manner which is transparent to the user.

In certain embodiments of the invention, a printer or hardcopy device may readily verify that that the separation distance lies within acceptable tolerances. In this manner, the likelihood of subsequent print defects and other incorrect operation may be significantly reduced. In some embodiments, the printer or hardcopy device is adapted to verify that the pen-to-paper spacing is satisfactory whenever new print media is loaded. In this manner, a user may not be required to input the paper thickness into the printer. This may be used to obviate the risk of an incorrect entry.

In some embodiments of the invention, the printer is adapted to allow the separation distance, or pen-to-paper spacing, to be subsequently adjusted if required, in order to bring it within predetermined values. This adjustment may be implemented either manually or automatically.

The present invention also extends to the corresponding methods. Furthermore, the present invention also extends to computer programs, arranged to implement the methods of the present invention. Further aspects of the invention will be apparent from the following description and appended claims.

BRIEF DESCRIPTION OF THE DRAWINGS

For a better understanding of the invention and to show how the same may be carried into effect, there will now be described by way of example only, preferred embodiments, methods and processes according to the present invention with reference to the accompanying drawings in which.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
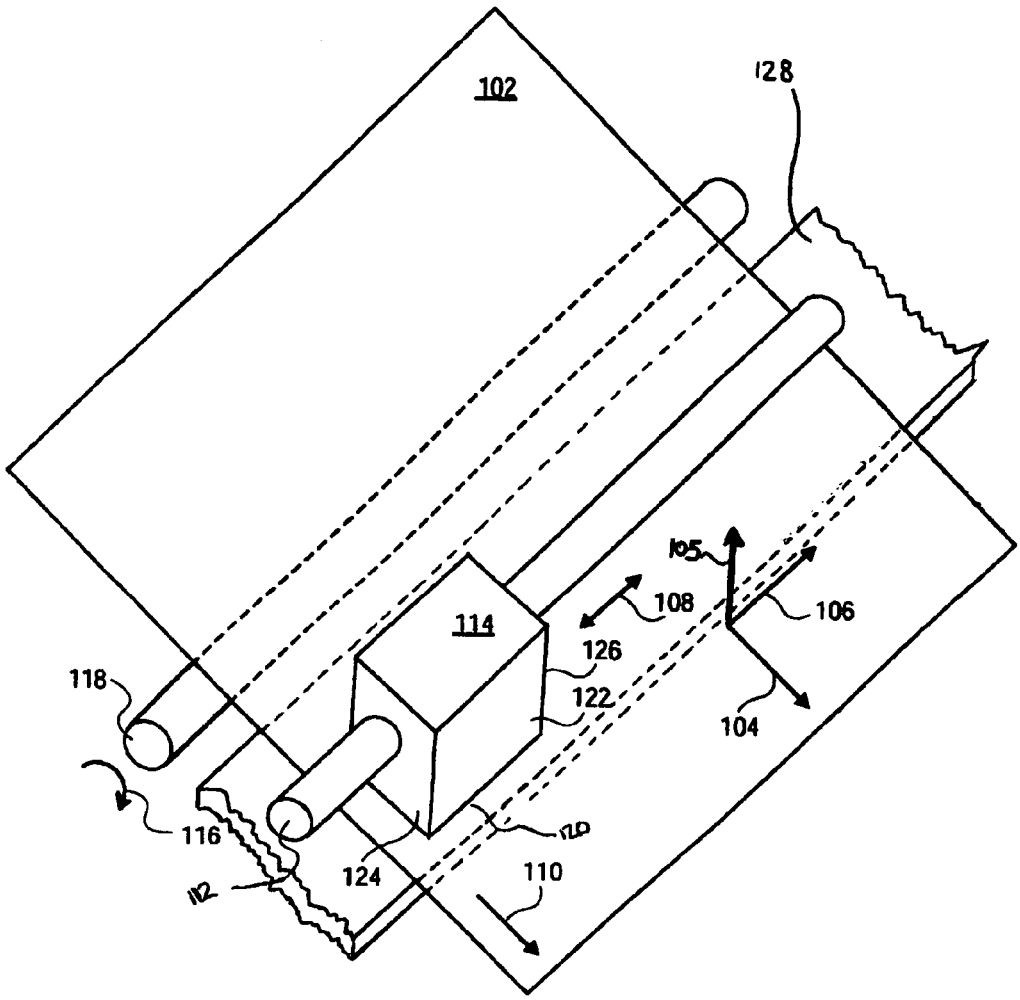
FIG. 1 is a schematic, perspective view of an image-forming device, according to an embodiment of the invention.

FIG. 1 shows a perspective view of an image-forming device, according to an embodiment of the invention. The device includes a shaft 112 on which a mechanism, or scanning carriage, 114 is slidably situated. The mechanism 114 has a left side 124, a right side 126, a front 122, and a bottom 120. The mechanism supports one or more printing heads (illustrated in FIG. 2*b*); in the present embodiment these are conventional inkjet print heads. The mechanism 114 is able to move back and forth along a scanning axis 106, as indicated by the bi-directional arrow 108. As the mechanism moves back and forth, the print heads may be controlled to eject ink on print media 102 located beneath the mechanism 114.

As can be seen from the figure, a sheet of print media 102 is supported by a print platen 128 in the region where the media receives ink from the print heads. The media 102 is advanced by a roller 118, which rotates in the direction indicated by the arrow 116. This causes the media 102 to move along a media axis 104 that is perpendicular to the scanning axis 106, as indicated by the arrow 110. Also illustrated in the figure is the axis 105, which lies perpendicular to both the media and scanning axes. In this embodiment, the axis 105 may be thought of as the vertical axis of the image-forming device.

The mechanism 114 also supports a media sensor 132 according to the present embodiment. The media sensor 132 is located in the lower surface 120 of the mechanism 114; consequently, the sensor 132 is not seen in FIG. 1, but is illustrated schematically in FIGS. 2*a* and 2*b*. The sensor is located such that it may sense or image the upper surface of the media 102, either as the mechanism 114 is scanning across the scan axis 106 or whilst the mechanism 114 is stationary.

Figure 2A:
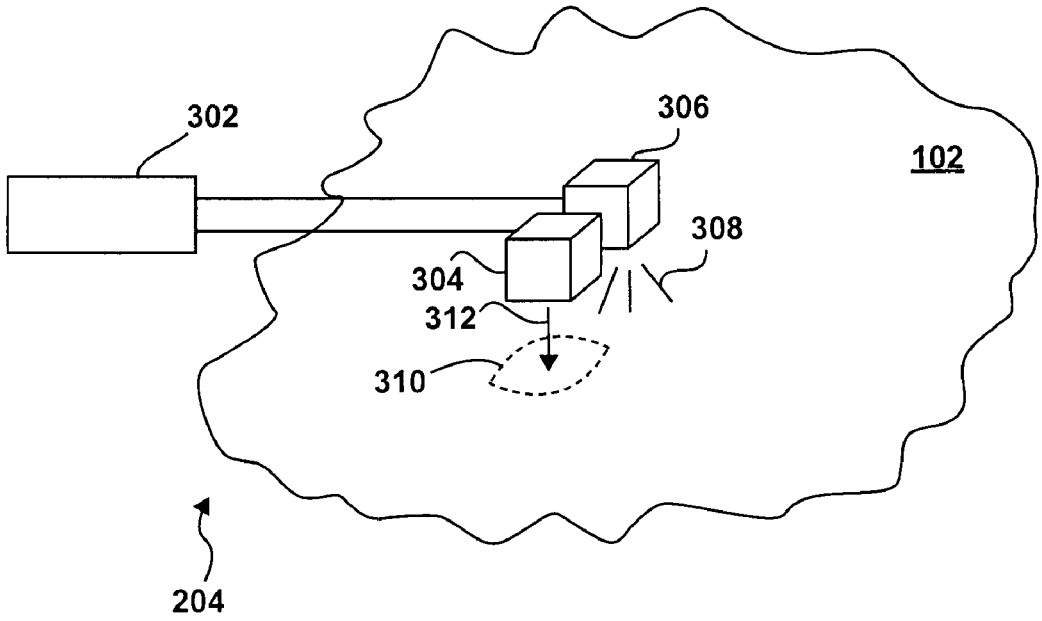
FIG. 2*a* is a schematic, perspective view of a media-positioning sensor, according to an embodiment of the invention.

FIG. 2*a* shows the media-positioning sensor 132 in more detail, according to an embodiment of the invention. The sensor 132 includes an optical sensing mechanism 304, an illumination mechanism 306, such as a light-emitting diode (LED), and a controller 302. The illuminating mechanism 306 illuminates a portion 310 of the media 102, as is indicated by the rays 308, so that the optical sensing mechanism 304 is able to capture a satisfactory image. For the sake of clarity, the platen 128 is not illustrated in this figure. The optical sensing mechanism 304 captures an image of a portion 310 of the media 102 that lies beneath the mechanism 304, as indicated by the arrow 312.

Figure 2B:
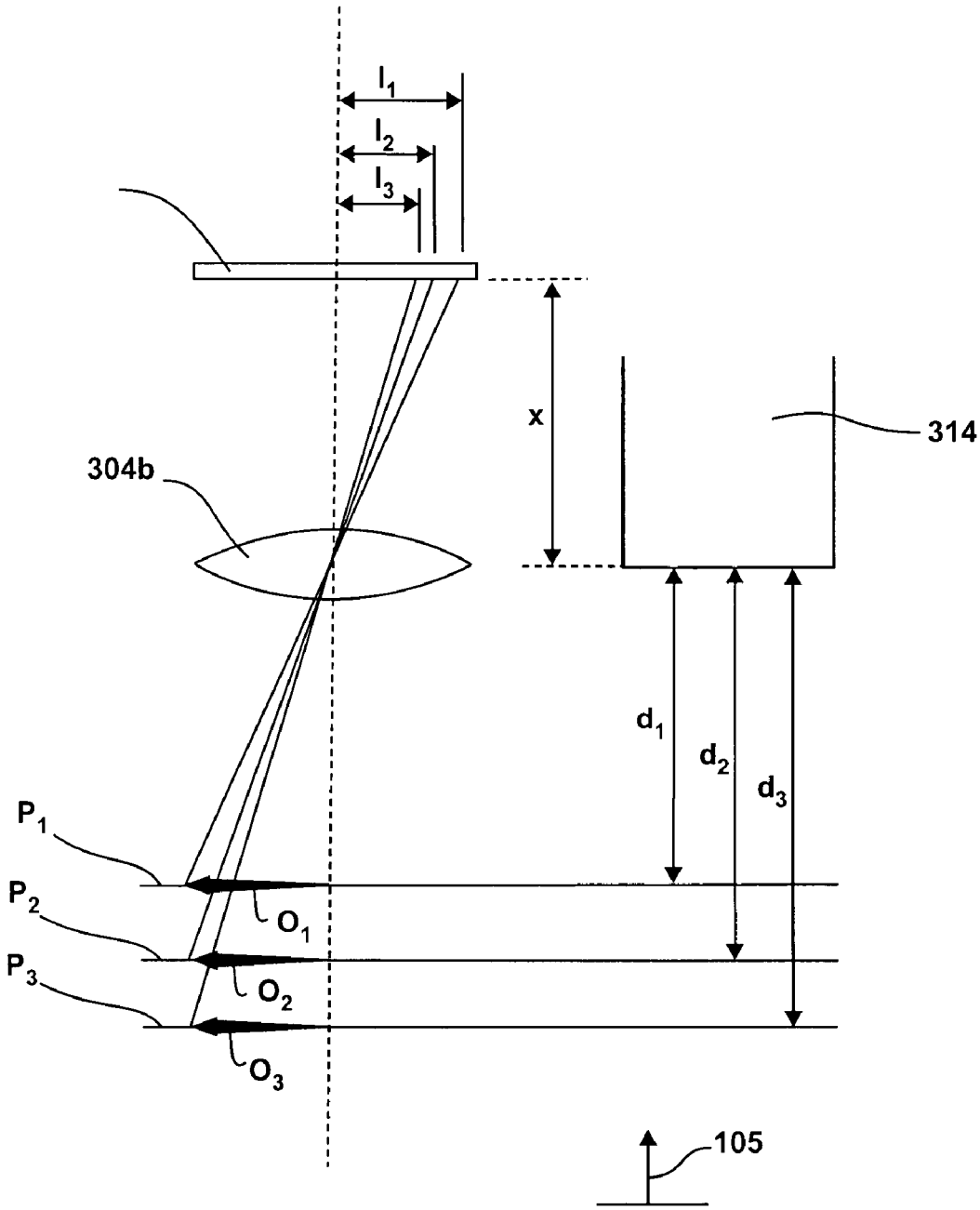
FIG. 2*b* is a schematic representation of the optical characteristics of the media-positioning sensor of FIG. 2*a;*

FIG. 2*b* schematically illustrates the pen-to-paper spacing "d" between a pen 314 and the upper, planar surface of a sheet of print media. In the figure three different exemplary pen-to-paper spacings $d_1$, $d_2$ and $d_3$ are illustrated. The distances $d_{1-3}$ in this example are measured along the vertical axis 105 of the image forming mechanism between the nozzle plate, or ink ejecting surface of the pen and the ink receiving or upper surface of the print media. At the distance $d_1$, the ink receiving surface of the print media is labelled $P_1$. At the increased distance $d_2$, the ink receiving surface of the print media is labelled $P_2$ and at the further increased distance $d_3$, the ink receiving surface of the print media is labelled $P_3$. The variation in the distances $d_{1-3}$ may in practice be caused by the use of print media of varying thicknesses. Alternatively, the bushes supporting the scanning carriage and pens may wear with use, thus progressively reducing the pen-to-paper spacing for media of a given thickness.

Also shown in the figure is a schematic of the optical sensing mechanism 304 illustrating the optical characteristics of the optical sensing mechanism 304. As can be seen from the figure, the optical sensing mechanism 304 has a sensor element 304*a*, which may be a charge-coupled device (CCD) sensor, a complementary metal-oxide semiconductor (CMOS) sensor, or another type of suitable optical sensor. The optical sensing mechanism 304 also has a conventional non-telecentric optical train 304*b* for generating an image of an object on the sensor element 304*a*. In the figure, the optical train 304*b* is illustrated schematically as a single optical element. However in practice a number of optical elements may be used.

In the present example, the optical sensing mechanism 304 is in a known, fixed position in the vertical axis 105 in relation to the print head 314. In this example, this "offset" distance is labelled "x" and represents the distance between the ink ejecting surface of the print head 314 and the surface of the sensor on which the an image is formed. Thus, each of the ink receiving surfaces of the print media, or planes $P_{1-3}$ forms an object plane a different distance from the optical sensing mechanism 304.

As can be seen from the figure, an object in the form of an arrow is schematically illustrated on each of the three object planes $P_{1-3}$. The objects on planes $P_{1-3}$ are respectively labelled $O_{1-3}$. In this example, each of the objects $O_{1-3}$ has the same dimensions and the same relative position on its respective plane as the other two objects.

Due to the optical characteristics of the non-telecentric optical train, the dimensions of the images of the objects $O_1$, $O_2$ and $O_3$ formed on the sensor varies with the distance separating each of the objects from the optical sensing mechanism 304 and/or the sensor element 304*a*. That is to say that generally as the distance separating an object from the optical sensing mechanism 304 decreases, the dimensions of its image on the sensor increase; i.e. it is magnified to a greater extent. Conversely, as the distance separating an object from the optical sensing mechanism 304 increases, the dimensions of its image on the sensor generally decrease.

For each of the objects $O_{1-3}$, the chief ray through the optical sensing mechanism 304 is illustrated in the figure. For the sake of clarity, the images are not illustrated in the figure. However, in each case, the length of the image of each object $O_{1-3}$ is illustrated by arrows, labelled $L_{1-3}$, respectively. As can be seen, the object $O_1$ lies closest to the optical sensing mechanism 304 and its image is the most highly magnified, having a dimension of $L_1$, measured from the optical axis of the system "y". The object $O_3$ lies furthest from the optical sensing mechanism 304 and its image is the least magnified, having a dimension of $L_3$. The object $O_2$ lies an intermediate distance from the optical sensing mechanism 304 and its image is correspondingly magnified to an intermediate degree, having a dimension of $L_2$.

In this manner, it will be understood that a set of relationships (this may be in the form of a look up table or one or more mathematical functions) may be determined, for a given operational set up and known size of object, relating a measured dimension of the image of that object to the distance between the optical sensing mechanism 304 and the object. By using, for example, a mark or test pattern of known dimensions on the surface of a sheet of print media as the object, the distance separating the mark, and therefore the ink receiving surface of the print media, from the optical sensing mechanism 304 may be determined. Furthermore, since the positional relationship between the optical sensing mechanism 304 and the print head is known (this may be a constant offset distance, for example) the pen-to-paper spacing may readily be derived.

Referring back to FIG. 2*a*, the controller 302, which is more generally a controlling mechanism, may be software, hardware, or a combination of software and hardware. The controller 302 controls the mechanisms 304 and 306 so that images are captured and media portions are illuminated at desired times. The images captured may be of marks of known dimensions printed on the surface of the print media by the printhead 314, for example.

One example of a media-positioning sensor suitable for use in embodiments of the present invention is described in U.S. Pat. No. 6,118,132 by Barclay, J. Tullis entitled, "System for Measuring the Velocity, Displacement and Strain on a Moving Surface or Web of Material" assigned to the assignee of the present invention and is herein incorporated by reference in its entirety.

Figure 3:
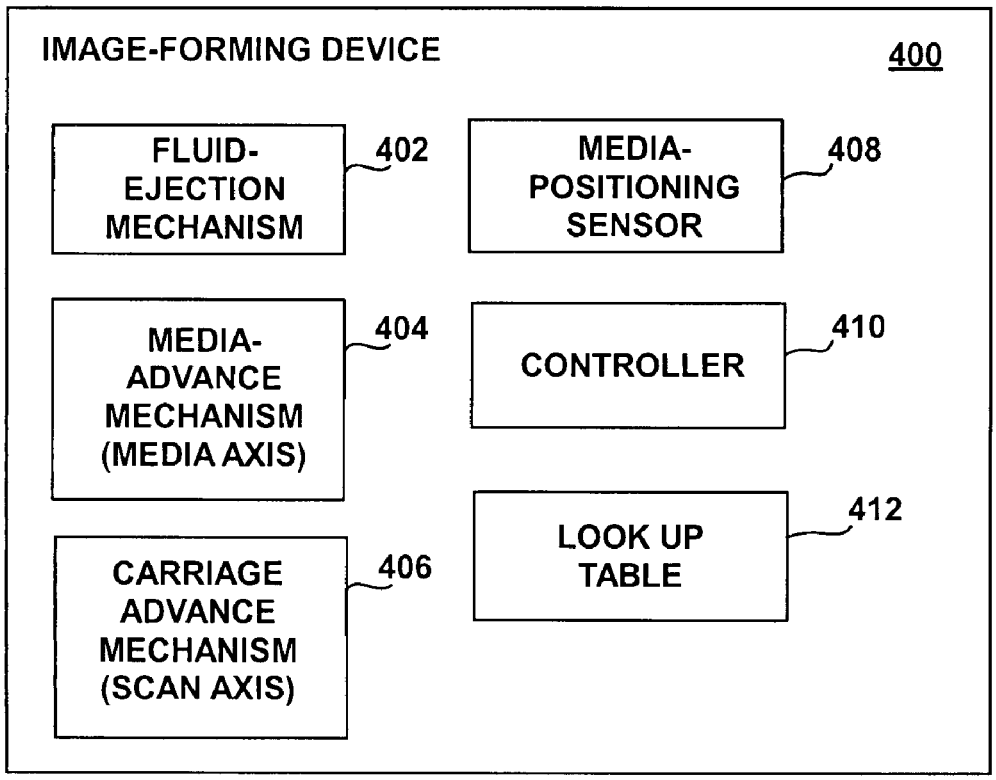
FIG. 3 is a block diagram of an image-forming device, according to an embodiment of the invention.

FIG. 3 shows a block diagram representation of an image-forming device 400, according to an embodiment of the invention. As can be appreciated by those of ordinary skill within the art, the image-forming device 400 may include components in addition to and/or in lieu of those depicted in FIG. 3. The image-forming device 400 may be a fluid-ejection device. The image-forming device 400 specifically is depicted in FIG. 3 as including a fluid-ejection mechanism 402, a media-advance mechanism 404, a carriage-advance mechanism 406, a media-positioning sensor 408, a controller 410 and a look up table 412. It will be understood that in general the various elements in FIG. 3 correspond to the elements described with reference to FIGS. 1 and 2. For example, the fluid-ejection mechanism 402 may comprise one or more inkjet print heads, such as that illustrated in FIG. 2*b*. Furthermore, the media-positioning sensor 408 may correspond to the optical sensing mechanism 304 illustrated in FIG. 2*a*, possibly including the illumination mechanism 306. The controller 410 illustrated in FIG. 3 may correspond to the controller 302, illustrated in FIG. 2*a*. In some embodiments, the controller 410 may control the operation of the media-positioning sensor 408 and also the operation of the image-forming device 400 in general. In other embodiments, separate controllers may be employed for these functions. The look up table 412 may be conventionally stored in memory associated with the controller 410.

Figure 4:
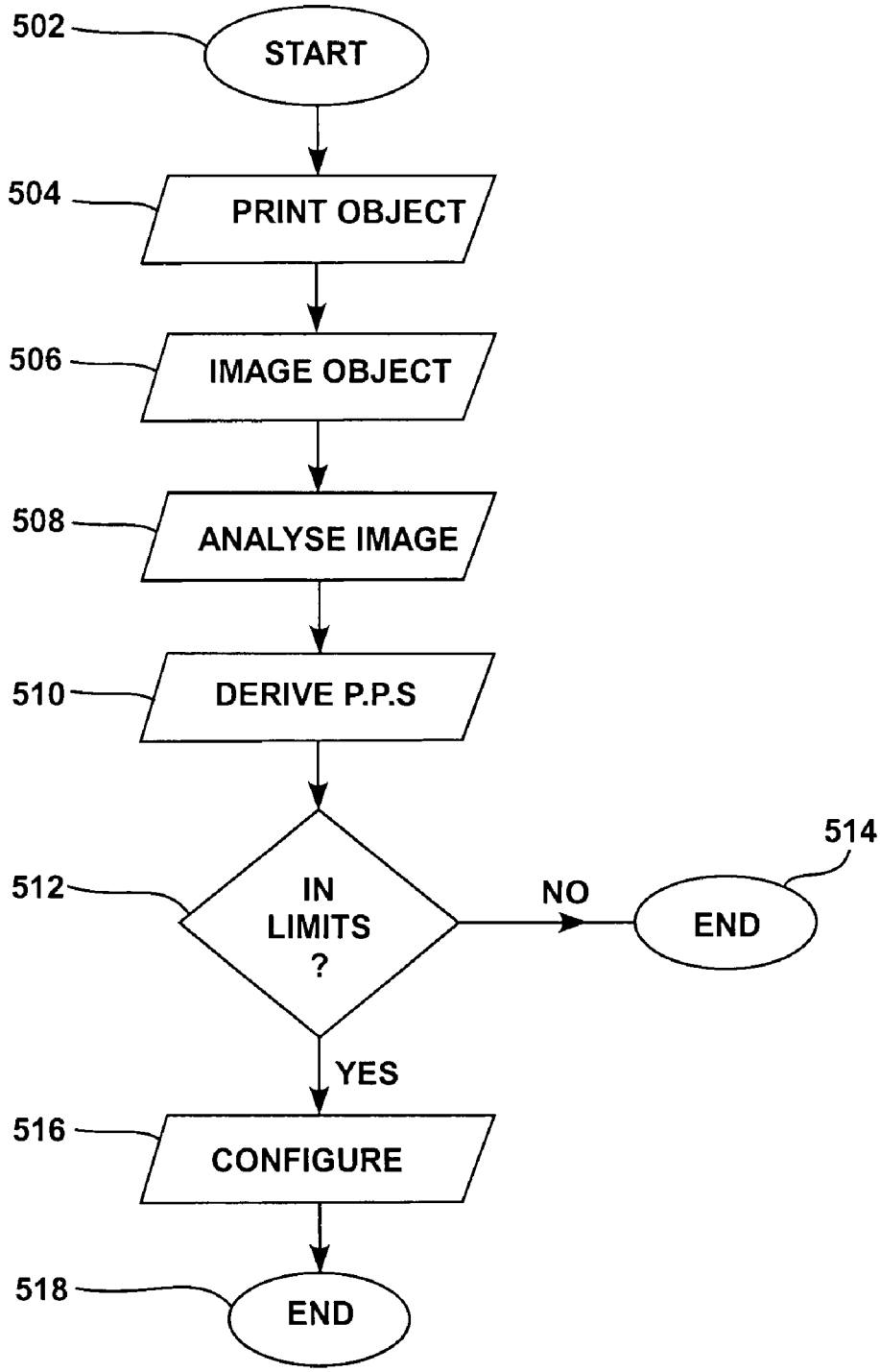
FIG. 4 is a flowchart of a method, according to an embodiment of the invention.

FIG. 4 illustrates a method 500, according to an embodiment of the invention. The method 500 will now be described with reference to the image-forming devices of FIG. 1-3.

At step 502 of the method, the controller 410 initiates a pen-to-paper measurement routine. This may be implemented periodically, or in response to particular events. Such events may include, for example, the loading of new print media into the image-forming device or an operator input.

Figure 5A:
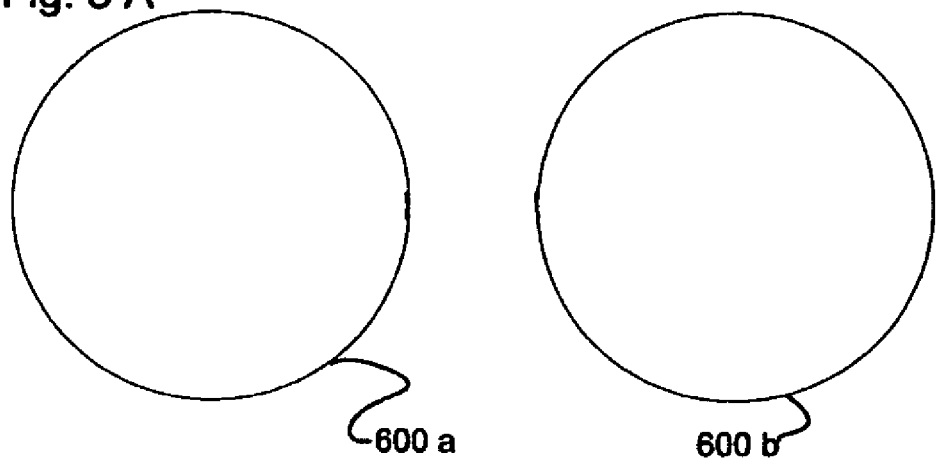
FIG. 5*a* is a schematic illustration of an object which may be imaged according to an embodiment of the invention.

At step 504 the controller 410 controls the fluid ejection mechanism 402, together with the media and carriage advance mechanisms 404, 406 to print a predetermined test pattern on a sheet of print media in a desired location. This may be performed in a conventional manner. In the present example, the test pattern consists of two circles 600*a*, 600*b* (illustrated in FIG. 5*a*) of known diameter, separated from one another by a known distance "a".

At step 506, the controller 410 controls the media-positioning sensor 408 to image the pattern, which may be viewed as the optical object, printed at step 502. The media-positioning sensor 408 may be stationary whilst it images the pattern. Alternatively, the media-positioning sensor 408 may image the pattern whilst the carriage traverses the scan axis. This may be, for example, immediately after the pattern is printed. It will thus be understood that the optical object may be moving relative to the media-positioning sensor 408 during the imaging step 506. Examples of images of the object are shown in FIGS. 5*b-d*.

At step 508, the controller 410 analyses the image of the object. In this step of analysis, the controller 410 measures a predetermined dimension of the image. In the present example, the dimension measured is the distance "a" separating the centres of the two circles 600*a*, 600*b* in the image. It will however be appreciated that any convenient dimension or combination of dimensions may instead be measured. This may be achieved using any conventional techniques, such as that described in U.S. Pat. No. 6,118,132.

Figure 5B:
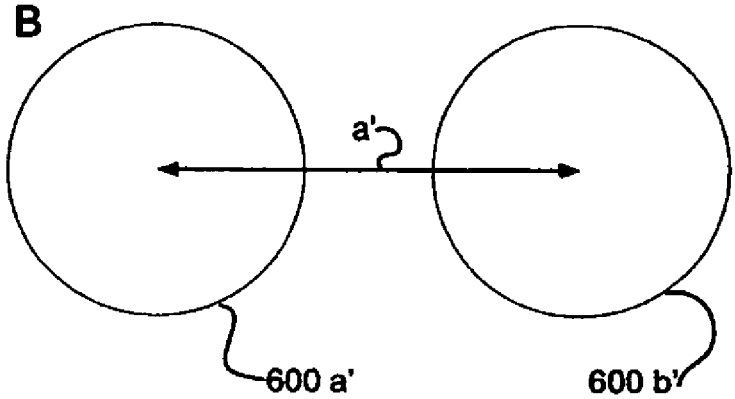
FIGS. 5*b-d* are diagrams illustrating exemplary images of the object of FIG. 5*a* generated by a media-positioning sensor according to an embodiment of the invention.
Figure 5C:
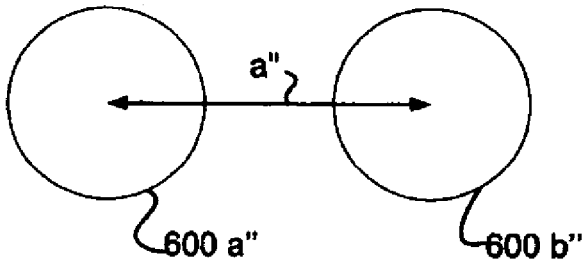
Figure 5D:
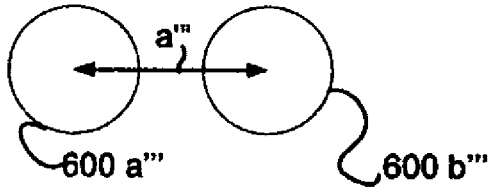

The process of analysing the image of the object is graphically illustrated in FIGS. 5*b-d*. FIGS. 5*b-d* illustrate exemplary images generated by the media positioning sensor 408, which are not to scale, of the printed test pattern shown in FIG. 5*a*. As can be readily seen from the figures, each of FIGS. 5*b-d*, shows an image of the test pattern made up of circles 600*a*, 600*b*. In the images 5*b-d*, the circles 600*a*, 600*b* are referenced: 600*a*', 600*b*'; 600*a*", 600*b*"; and, 600*a*'", 600*b*'", respectively. Each of the figures shows the image magnified to a different extent. As has been described with reference to FIG. 2*b*, the difference in magnification of the images shown in FIGS. 5*b-d* is caused by different distances between the media positioning sensor 408 and the optical object when the different images were captured; i.e. varying pen-to-paper spacing. As can be seen from FIGS. 5*b-d*, the image shown in FIG. 5*b* is magnified to a greater extent that is the image shown in FIG. 5*c*. Similarly, the image shown in FIG. 5*c* is magnified to a greater extent than is the image shown in FIG. 5*d*. Thus, the image at high magnification illustrated in FIG. 5*b* may correspond to a relatively small distance between the media positioning sensor 408 and the surface of the print medium, as is represented by the position $P_1$ of the print medium FIG. 2*b*. The image at low magnification illustrated in FIG. 5*d* may correspond to a relatively large distance between the media positioning sensor 408 and the surface of the print medium, as is represented by the position $P_3$ of the print medium FIG. 2*b*. The image at an intermediate magnification illustrated in FIG. 5*c* may correspond to an intermediate distance between the media positioning sensor 408 and the surface of the print medium, as is represented by the position $P_2$ of the print medium FIG. 2*b*.

The distance "a" separating the centre of imaged circles 600*a*, 600*b* in FIGS. 5*b-d* are referenced a', a" and a'", respectively. As can be seen from the figures, this distance varies with the degree of magnification of the image; and so with the pen-to-paper spacing. Thus, this distance a' in FIG. 5*b* is greater than the equivalent distance a" in FIG. 5*c*. Similarly, the distance a" in FIG. 5*c* is greater than the equivalent distance a'" in FIG. 5*d*.

At step 510, the controller 410 finds in the look up table 412 a measured dimension corresponding to that distance "a" measured at step 508. Associated with the measured dimension value in the look up table 412 is a value for the distance separating the nozzle plates of the pens and the ink receiving surface of the print media; i.e. the pen-to-paper spacing. This look up table 412 may generated and loaded into memory associated with the image forming device on manufacture using conventional techniques. The skilled reader will understand that not all values for the measured dimension and the corresponding pen-to-paper spacing need be stored in the look up table 412. Intermediate values may be determined by the controller 410 using a conventional interpolation process.

At step 512, the controller 410 determines whether the pen-to-paper spacing value obtained at step 510 lies within the range of values permitted. If, for example, the bushings of the scan axis have become too worn, or if the user has inserted print media that is too thick to allow reliable printing, then the controller may generate a warning message and may prevent printing from occurring at step 514. If on the other hand, the controller determines that the pen-to-paper spacing value obtained at step 508 lies within the range of values permitted, then the method may proceed to step 516.

At step 516, the controller may determine whether the operation of the image-forming device should be modified in dependence upon the measured pen-to-paper spacing.

As the skilled reader will appreciate, in scanning printers which have pens which are offset from one another in the scanning direction, nozzles in different pens must fire at different times in order to print dots at the same point along the scan axis. This firing delay between pens depends upon the spacing between the pens in the scan axis direction and the scan speed, together with the directionality of ink drop ejection in the scan direction of the print heads in question. Generally, it is an aim of pen manufacture that each pen ejects ink at the same angle. However, due to manufacturing variations, this ink drop ejection angle may vary significantly between pens. Because of this, when pens are changed, test patterns are conventionally printed so that the ink drop ejection angle characteristics of the pens can be measured. The appropriate delays between the firing of one pen and another are then calculated to ensure that ink drops ejected by those pens that are meant to be located on the print media at the same point along the scan axis, are so located. However, these delays are dependent upon the pen-to-paper spacing. Therefore, if the pen-to-paper spacing subsequently changes, pens with different ink drop ejection angle characteristics will print drops, which should occupy the same position on the media in the scan axis direction, at different positions on the media in the scan axis direction. This may be viewed as giving rise to a "registration" type error.

Thus, at step 516, the controller may determine the delay required between the firing of one pen and another, in dependence upon the measured pen-to-paper spacing, in order to reduce this registration type error. The required delays may be determined in any suitable manner; for example through the use of further look-up-tables. The controller may then modify the printing control algorithms to incorporate the required delays.

At step 516, the controller ends the method 500. The image-forming device may then be ready to commence printing a print job.

FURTHER EMBODIMENTS

In the above description numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

For example, the skilled reader will appreciate that although the above embodiment was described with reference to a scanning inkjet printer, it may also be applied to a non-scanning printer, such as a page wide array. Furthermore, the present invention may also be applied to any image forming device where it is desirable to measure or control the distance between a printing mechanism and image receiving surface. Thus, embodiments of the present invention may be applied to laser printers and liquid electrophotographic printers amongst others, for example.

In the above embodiments it has been assumed that the pen-to-paper spacing is constant across the length of the scan axis. In practice, in certain printers, this may not be the case. This may be due to various factors, such as: a lack of manufacturing precision; incorrect set up; or, uneven wear over time. Where the pen-to-paper spacing is not constant across the length of the scan axis, the firing delay between different pens separated in the scanning direction is preferably varied across the scan axis in accordance with the local value of the pen-to-paper spacing. That is to say that the firing delay between such pens preferably varies in dependence upon the position of those pens, or the carriage in which they are mounted, across the scan axis. In this way, ink dots printed by different print heads may be correctly registered along the length of the scan axis. In one embodiment of the invention, the pen-to-paper spacing may be measured, as described above, at various points across the scan axis. In this manner, a pen-to-paper spacing profile may be generated for up to the entire scan axis length. The skilled reader will appreciate that the number of pen-to-paper spacing measurements could be any reasonable number. Interpolation techniques could be used to estimate the pen-to-paper spacing in areas where no measurement is made, should this be required.

The skilled reader will appreciate that such a profile could be used in a variety of printing systems other that that described; for example, a printing system in which the image is generated on directly on a drum, or in which print media is supported on a drum platen. Furthermore, where a drum platen is employed, such a profile could be additionally or alternatively be generated for the pen-to-paper spacing in a circumferential direction around the perimeter of the drum. In this manner, an eccentricity in the drum mounting, which causes a varying pen to paper spacing as the drum rotates relative a printhead could be compensated for. One or more such circumferential profiles could in practice be generated at corresponding locations along the rotational axis of the drum.

The skilled reader will also appreciate that such profiles may be generated or verified periodically, for example as part of a user instigated servicing routine. Alternatively, it could be generated or verified on an almost continuous basis. For example, where a printer is printing text of given characteristics (font style and size etc.) the media-positioning sensor may continually image given letters, for example, under the control of the controller. In this manner, the controller may employ the techniques descried above to determine the local pen-to-paper spacing at many point across the scan axis and/or circumferentially about a rotating platen if appropriate, in an ongoing manner during normal use. In this way, time, print media and ink need not be expended in order to implement the pen-to-paper spacing measurement process of embodiments of the present invention.

Furthermore, in embodiments of the invention, a printer may be provided with a scan axis assembly that can be moved relative (towards or away) to the platen. In this manner, the pen-to-paper spacing may be modified in accordance with the determined pen-to-paper spacing measurement. For example, if a user inserts a sheet of print media which reduces the pen-to-paper spacing to an undesirably low level, the pen-to-paper spacing may then be increased to a normal level. This may be achieved manually. In this case, the user may make a suitable mechanical adjustment to the pen-to-paper spacing (using for example a cam system or a differential screw system). In such a situation, the user may follow instruction ouput by the printer on a user readable display, for example. Alternatively, the printer may be provided with one or more motors with which the pen-to-paper spacing may be adjusted automatically.

In the above-described embodiments, the media-positioning sensor was located on the scanning mechanism or carriage. However, the skilled reader will understand that in practice, it may be located in any convenient location. Thus, it may be located statically in relation to the platen. In any event, however, it is preferable that it does not undesirably obstruct moving elements of the printer, such as the advance of the carriage or the media.

In the above-described embodiments, the optical object imaged by the media-positioning sensor was printed by the printer. However, the skilled reader will understand that in practise, any suitable object may be used. For example, suitable inherent physical aspects of the media may be used as optical objects. These may be watermarks or elements or particles embedded in the media. Such elements or particles may take the form of metal foils, for example, as used in security papers.

It will also be understood that in simple embodiments of the invention, a printer may be adapted to compare a measured dimension or area of an image with a single stored comparison value. This may allow the printer to determine whether the pen-to-paper spacing lies above or below a given minimum threshold. In dependence upon this determination, printing may be permitted or inhibited.

What is claimed:

1. A printer device comprising a mechanism adapted to generate a printed image on a print media, the device comprising a sensor adapted to image a plurality of optical objects located at a corresponding plurality of locations on the print media, the device being adapted to determine at least one dimension of each object's image by scanning along a path relative to the print media and thereby determine a corresponding distance separating the mechanism and the print media, at each of the plurality of locations by determining a measured distance between at least two of the optical objects on the print media, the printer device being adapted to generate a profile corresponding to a variation in distance separating the mechanism and the print media, at different locations along the scanned path and to vary the timing of image generation of the mechanism at different points along the scanned path in dependence upon the generated profile.

2. A device according to claim 1, wherein the sensor comprises an optical system for generating an image of the object, wherein the magnification of the image varies in dependence, or proportionally, upon the distance separating the object and the optical system.

3. A device according to claim 2, wherein the mechanism is located in a known position in relation to the sensor in an axis perpendicular to the print media.

4. A device according to claim 1, further comprising stored data, such as a look up table, or a mathematical function relating values for the determined dimension to distances separating the mechanism and the print media.

5. A device, according to claim 1, further arranged to vary the timing of image generation of the mechanism in dependence upon the determined distance.

6. A device according to claim 1, further comprising a scanning carriage adapted to support both the mechanism and the sensor.

7. A device according to claims 1, wherein the plurality of locations are arranged in a substantially linear array across a first dimension of the print media.

8. A device according to claim 1, wherein the print media comprises a cylindrical surface, the plurality of locations being arranged circumferentially about the cylindrical surface.

9. An inkjet device according to claim 1, wherein the mechanism is an inkjet printhead.

10. A device according to claim 9, comprising first and second inkjet printheads arranged to scan sequentially along the scan path, the device being adapted to control the firing timing of one printhead to lag behind that of the other, such that the degree of lag varies in dependence upon the generated profile.

11. A device according to claim 1, wherein the device is adapted to image a non-printed object lying in or on the print media.

12. A device according to claim 11, wherein the print media is sheet of print media.

13. A device according to claim 12, wherein the object is a non-printed object.

14. A device according to claim 13, wherein the non-printed object is a watermark, or an element or particle incorporated into the sheet.

15. A device according to claim 1, wherein the object has at least one predetermined dimension, the device adapted to determine the corresponding dimension in the object's image.

16. A device according to claim 1, further adapted to calculate a difference value between the determined distance separating the mechanism and the print media and a nominal distance.

17. A device according to claim 16, further comprising one or more actuators arranged to modify the distance separating the mechanism and the print media in dependence upon the difference value.

18. A device according to claim 17, adapted to output data to a user corresponding to the difference value and comprising user controls permitting manual adjustment of the distance separating the mechanism and the print media.

19. A method of determining the spacing between an image creation mechanism and an image surface in a hardcopy apparatus, comprising:

imaging an object in the plane of the image surface;

determining the magnification of the object's image;

deriving the spacing in dependence upon the determined magnification;

repeating the steps of imaging, determining and deriving for a plurality of objects located at a plurality of corresponding locations along a scanning path over the image surface by determining a measured distance between at least two of the optical objects on the image surface;

generating a profile corresponding to the variation in distance separating the mechanism and the image surface at different locations along the scanning path; and varying the timing of image generation of the mechanism at different points along the scanning path, in dependence upon the generated profile.

20. A method according to claim 19, further comprising varying the timing of image generation of the mechanism in dependence upon the derived spacing.

* * * * *